US005826519A

United States Patent [19]

Saitoh

[11] Patent Number: 5,826,519

[45] Date of Patent: Oct. 27, 1998

[54] HEARTH BED AND A FURNACE WITH A PARTICLE HEARTH BED

[76] Inventor: Shigeru Saitoh, 169, Dai, Obamamachi, Iwaki-shi Fukushima 974, Japan

[21] Appl. No.: 411,608

[22] PCT Filed: Feb. 9, 1994

[86] PCT No.: PCT/JP94/01447

§ 371 Date: Apr. 7, 1995

§ 102(e) Date: Apr. 7, 1995

[87] PCT Pub. No.: WO95/06844

PCT Pub. Date: Mar. 9, 1995

[30] Foreign Application Priority Data

Sep. 3, 1993 [JP] Japan ..... 5-242170

[51] Int. Cl.[6] ..... F23G 5/00

[52] U.S. Cl. ..... 110/248; 110/255; 422/143; 422/145

[58] Field of Search ..... 110/245, 255, 110/248, 225; 422/141, 143, 145; 165/104.16

[56] References Cited

U.S. PATENT DOCUMENTS

| | | | |
|---|---|---|---|
| 4,154,581 | 5/1979 | Nack et al. | 110/245 X |
| 4,330,502 | 5/1982 | Engstrom | 422/142 |
| 4,991,519 | 2/1991 | Saitoh | 110/255 X |
| 5,209,169 | 5/1993 | Basic, Sr. | 110/248 X |

FOREIGN PATENT DOCUMENTS

| | | |
|---|---|---|
| 51-68841 | 5/1976 | Japan . |
| 60-101533 | 7/1985 | Japan . |
| 62-182512 | 8/1987 | Japan . |
| 2-203109 | 8/1990 | Japan . |
| 3-50925 | 8/1991 | Japan . |

*Primary Examiner*—Henry A. Bennett
*Assistant Examiner*—Susanne C. Tinker
*Attorney, Agent, or Firm*—Flynn, Thiel, Boutell & Tanis, P.C.

[57] ABSTRACT

A hearth particle bed system is made up of channel members which form an inclined surface upon which a layer of hearth particles downwardly flow. An air inlet is provided underneath the channel member and apertures are provided in the channel members for redistributing the air flow through the hearth particles. A hearth particle incinerating furnace contains the above-described hearth particle bed system and further contains a combustion chamber and a mechanism for removing used hearth particles and combustion residues. This hearth particle incinerating furnace enables combustion air to be uniformly distributed in the hearth particle bed and can operate in a stable fashion for a long period of time without problems associated with pluggage of the air inlets.

2 Claims, 4 Drawing Sheets

HEARTH BED AND A FURNACE WITH A PARTICLE HEARTH BED

FIELD OF THE INVENTION

The present invention is directed to a hearth bed furnace in which a hearth particle bed flows down an inclined surface and a material to be incinerated contacts and is supported in the moving hearth particle bed.

BACKGROUND OF THE INVENTION

A typical particle incinerating furnace in current use utilizes hearth particles to form a hearth particle bed which moves in a non-fluidized fashion to incinerate materials in a combustion chamber. Japanese Patent Specification Hei No. 2-203109 (Kokoku No. 6-56256) operates in such a fashion and has air inlet tubular members for promoting burning which are provided in the furnace facing the hearth particle bed. However, to increase the amount of air introduced into the combustion chamber, it is necessary to enlarge the tubular members with air inlet apertures provided therein and increase the number of these tubular members which consequently m interferes with the movement of the hearth particle bed.

Japanese Patent Application Hei No. 4-358066 (Kokai No. 6-193845) discloses a particle incinerating furnace in which air is introduced to a moving hearth particle bed from air inlets provided at a lower portion of the hearth particle bed to incinerate materials introduced at an upper part of the furnace. In this reference, the air inlets for promoting the burning of the materials come into direct contact with the hearth particles so that the hearth particles often plug the air inlet and become stuck therein. This results in the movement of the hearth particle bed being obstructed and the introduction of necessary combustion air is hindered.

It has been attempted to solve the above-described problems in particle bed incinerating furnaces by reducing the size of the air inlet. However, this may result in a decrease in the amount of combustion air introduced to the furnace and insufficient incineration.

SUMMARY OF THE INVENTION

The present invention overcomes the above-discussed problems by providing a hearth particle bed system utilized in the incineration of materials in a hearth particle incinerating furnace which comprises a first inclined surface; at least one channel member forming a second inclined surface and provided above said first inclined surface; means for introducing hearth particles onto said second inclined surface; a layer of hearth particles flowing down said second inclined surface; air inlet means provided in said first inclined surface for promoting burning of a material to be burned; and air flow redistribution means provided in said channel member for redistributing the air flow through the hearth particle layer.

The present invention also is directed to a hearth particle bed system comprising a first inclined surface; at least one channel member forming a second inclined surface and provided above said first inclined surface; means for introducing hearth particles onto said second inclined surface; a layer of hearth particles flowing down said second inclined surface; air inlet means provided in said first inclined surface for promoting burning of a material to be burned; and a plurality of air flow redistribution apertures provided in sides of the channel member for redistributing the air flow through said hearth particle layers.

A further aspect of the present invention is directed to a hearth particle incinerating furnace comprising a first inclined surface; at least one channel member forming a second inclined surface and provided above said first inclined surface; means for introducing hearth particles onto said second inclined surface; a layer of hearth particles flowing down said second inclined surface; a combustion chamber; air inlet means provided in said first inclined surface for promoting burning of a material to be burned; a plurality of air flow redistribution apertures provided in sides of said channel member for redistributing the air flow through said hearth particle layer; an outlet provided at a lower portion of the combustion chamber; and removal means provided at said outlet for removing a mixture containing used hearth particles and combustion residues.

DESCRIPTION OF THE PREFERRED EMBODIMENTS

Figure 1:
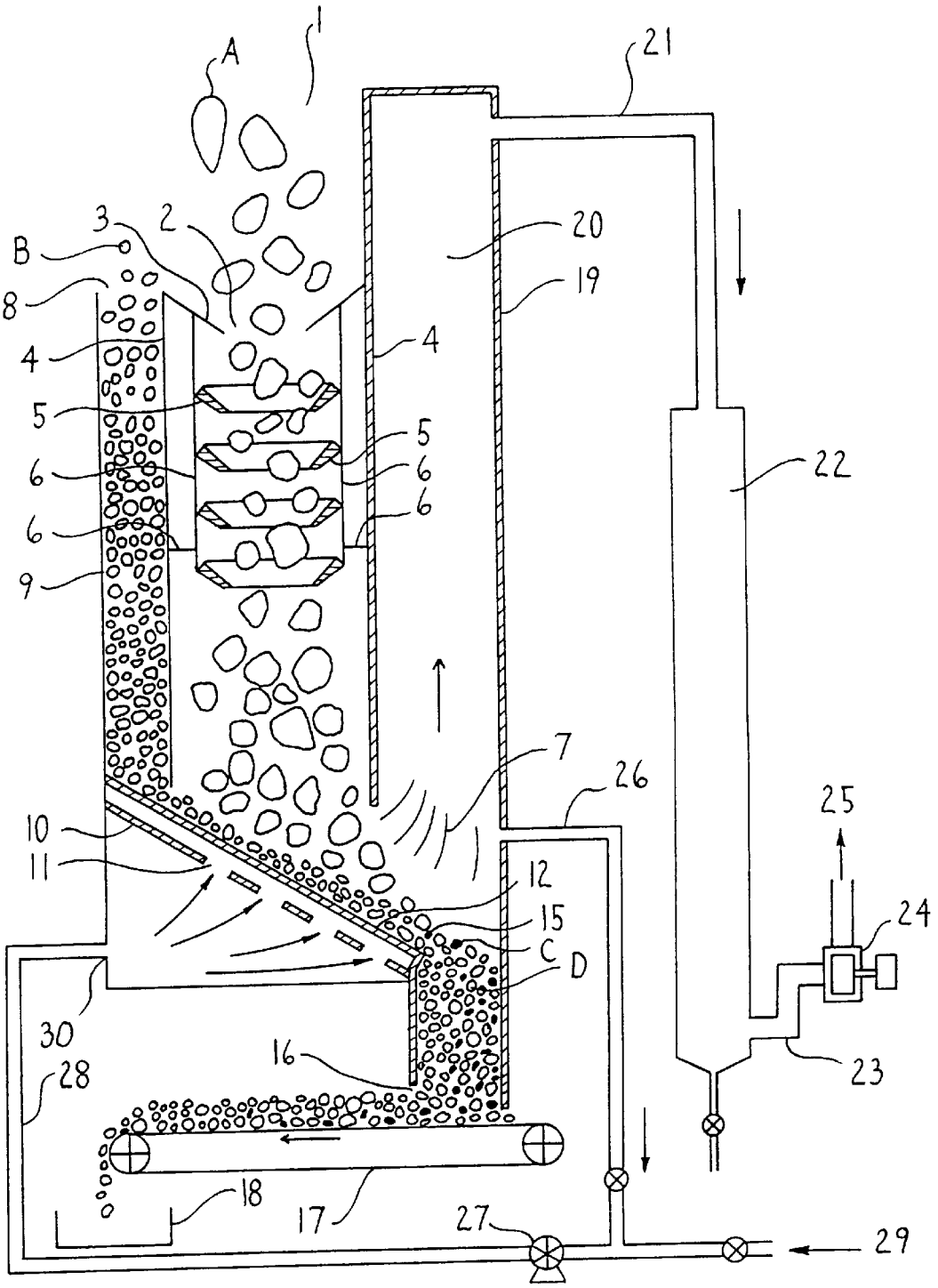
FIG. 1 is a partial sectional view of an incinerating furnace containing a hearth particle bed system according to the present invention.
Figure 2:
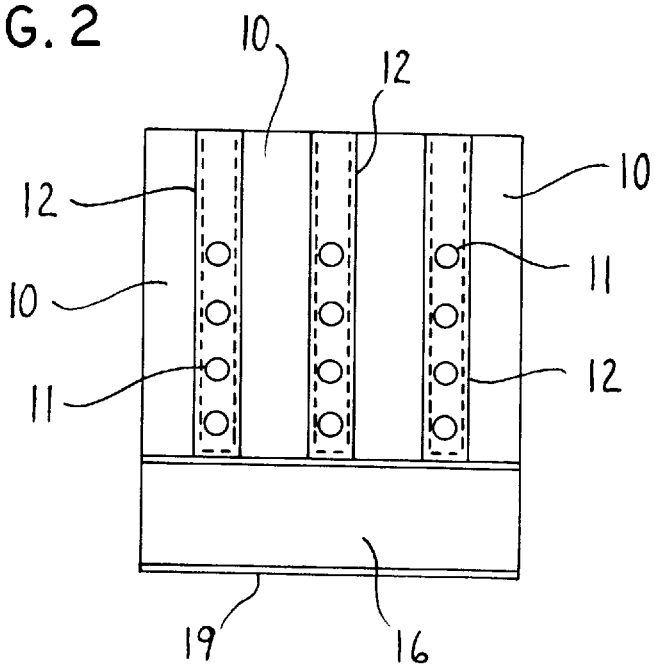
FIG. 2 is a plan view illustrating the inclined surfaces, air inlets and combustion chamber outlet of the particle bed system of the present invention.
Figure 3:
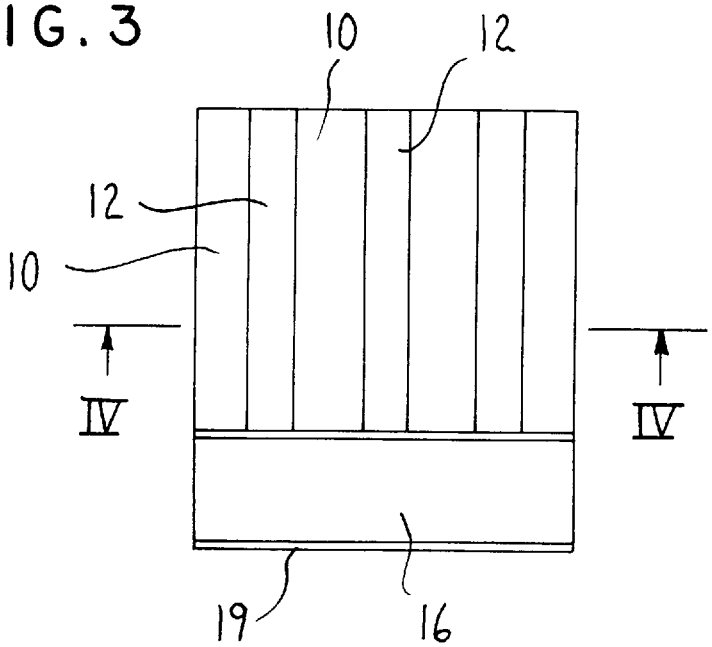
FIG. 3 is a plan view illustrating the attachment of the channel members of the present invention.

As illustrated in FIG. 1, the hearth particle incinerating furnace of the present invention comprises an inlet 1 through which burning materials A are introduced into a hopper 3 of the furnace. The opening 2 of the hopper 3 decreases as it extends into the furnace to avoid contact of the furnace sidewalls 4 with the burning material. Alternatively, annular baffles having a central opening which decreases as they extend along the length of the hopper 3 can be contained in the hopper in order to direct the flow of the burning material A toward the center of the hopper. Portions of the sidewall 4 exposed to high temperatures should preferably be covered by a fireproof material and a lower portion of the sidewall 4 makes up a part of the combustion chamber 7.

Hearth particles B are introduced into the furnace at an inlet 8 adjacent to the inlet 1 for the burning materials A. The hearth particles B fall along a chamber formed between the sidewall 4 and an outer sidewall 9 into contact with an inclined channel member 12.

Figure 4:
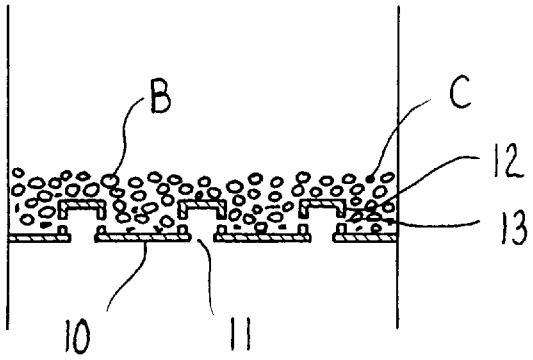
FIG. 4 is a sectional view taken along the line IV—IV of FIG. 3.
Figure 7:
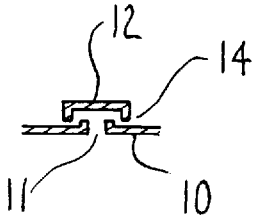
FIG. 7 is a sectional view taken along the line VII—VII of FIG. 6.

As shown in FIGS. 4 and 7, the channel member 12 is provided with an upper bight portion and two downwardly extending leg portions. A lower plate member 10 is provided underneath the channel member 12 and is inclined at an angle preferably about equal to that of the angle of repose of the hearth particles B. A plurality of air inlet apertures 11 are provided in the lower plate member 10 for promoting the combustion of the materials to be burned A.

The legs of the channel members 12 have a plurality of air outlet apertures 13 or slits provided in their sides and maintain the upper bight surface a fixed distance from the plate member 10. The upper bight portion of the channel member 12 is inclined at an angle approximately parallel to that of the plate member 10 and serves as a second inclined surface upon which a layer of hearth particles flow into the combustion chamber 7. The upper surface of the bight portion of the channel 12 contains no apertures therein and is flat.

The hearth particles B form a hearth particle bed layer 15 and flow downwardly on the upper surface of the channel member 12. The channel members 12 preferably do not have open upper ends or, if they do, the upper ends of the channel members 12 are closed to aid in the flow of the hearth particles. Additionally, the ends of the channel members 12 are also closed to prevent air leakage.

The hearth particles B that can be used in the present invention can be any type of particles, such as natural crushed mineral stone, coarse sand and iron particles, that are sufficiently durable under high temperature conditions and form sufficient gaps therebetween for air to flow between the hearth particle to the combustion chamber when they are contained therein as a hearth particle bed 15. A suitable mean particle diameter of the hearth particles is from about 1 cm to about 20 cm, preferably from about 3 cm to about 15 cm.

The hearth particles B forming the hearth particle bed layer 15 sequentially move by gravity continuously or intermittently along the top surface of the channel member 12 without being fluidized and, due to the top surface of the channel member 12 being inclined at an angle approximately equal to the angle of repose of the hearth particles B, the layered shape of the hearth particle bed layer 12 does not change. The angle of repose of the hearth particles B can readily be determined by one of ordinary skill in the art depending on the characteristics of the materials and the shape and the diameter of the particles and the angle of inclination of the channel member 12 and the plate member 10 can be adjusted accordingly.

Figure 6:
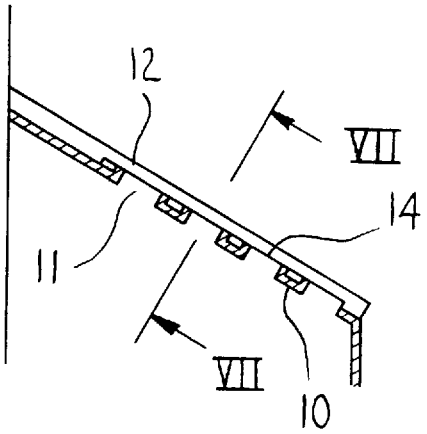
FIG. 6 is a partial sectional view of a channel member of the present invention.

In the present invention, the combustion chamber 7 is an area comprising a lower portion of sidewall member 4, a lower portion of wall 9 and the plate member 10. The air inlets 11 are provided in the plate member 10 for promoting burning of the material A. The air inlet 11 may be an aperture with, as shown in FIGS. 6 and 7, the channel member 12 provided above the aperture 11. The air blown upwardly through the inlet 11 has its directional flow changed and is introduced into the hearth particle bed 12 through a plurality of apertures 13 or slits 14 provided in the channel member 12.

Figure 5:
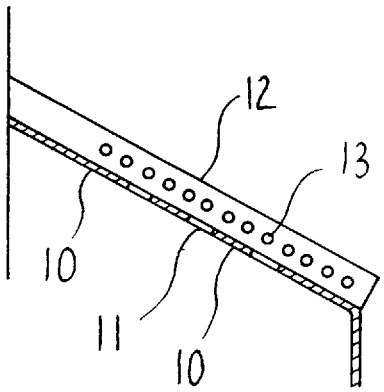
FIG. 5 is a partial sectional view illustrating the arrangement of air inlet apertures on the channel member.

The diameter of the air inlets 11 may be comparatively large, for instance, from about 3 cm to about 10 cm. The diameter of the apertures 13 provided in the channel member 12 are smaller than that of the hearth particles B in order to prevent them from dropping into the apertures 13. As is illustrated in FIG. 5, there are a plurality of apertures 13 provided in the channel member 12 and they typically have a diameter of from about 1 mm to about 3 cm, preferably from 3 mm to 8 mm. The width of the slit 14 may be about the same size as the apertures 13 and the length of the slit 14 is not critical as long as it does not weaken the channel member 12 itself. That is, all that is required is that the slit 14 be shorter than the channel member 12 with the number and position of the slits not being restricted.

The portions of the furnace which are exposed to high temperatures such as the lower plate member 10, the channel members 12 of the lower portion of the sidewall member 4 and the lower portion of the wall 9 are covered by a fireproof material to prevent heat damage to them.

In the furnace, the materials A incinerate and form a small amount of combustion residues C which mix with hearth particles B and become a combustion mixture D. The combustion mixture D exits the furnace via outlet 16 and onto a means 17 for removing the combustion mixture 16 from the furnace. Although a conveyor belt 17 is illustrated as the means for removing the combustion mixture, other mechanisms such as rotary gears, diaphragms and rotary cylinders can be used also.

As illustrated in FIG. 1, when a conveyor belt 17 is used as the means for removing the combustion mixture D, the combustion mixture D exits the outlet 16 of the furnace and falls onto the surface of the conveyor belt 17. The outlet 16 is formed such that the combustion mixture D deposits on the conveyor belt 17 at an angle approximately equal to the angle of repose of the hearth particles B. Due to this design, the combustion mixture D removed from the outlet 16 does not spread over the area defined by the angle of rest of the mixture D and the distance between the outlet 16 and the conveyor belt 17. As such, the combustion mixture D will not unexpectedly spread over the conveyor belt and spill if the conveyor belt is designed to have a certain area larger than the area required by the angle of repose and the distance between the conveyor belt 17 and the outlet 16. Moreover, the distance between the outlet 16 and the conveyor belt 17 can be changed if so desired.

Once the combustion mixture D is deposited on the conveyor belt 17, it is transported to a collection box 18 at the discharge end of the conveyor belt. After being deposited in the collection box 18, the combustion residue C can be separated from the combustion mixture D and the hearth particles separated and recycled back into the furnace.

The waste gas of combustion produced by the incineration of material A travels up along wall 19, which is covered by a fireproof material, and passes through a heat exchanger member 20, an exhaust pipe 21, a cooling and washing tower 22, a ventilating fan inlet 23, a ventilating fan 24 and is discharged through a chimney 25.

A part of the high temperature waste gas of combustion chamber 7 is removed through duct 26, circulation fan 27 and duct 28 and is mixed in a predetermined ratio with fresh air at room temperature and introduced through the air inlets 11 and finally through the air apertures 13, 14 of the channel members 12 to incinerate the materials to be burned 8.

The shape of the hearth bed and the hearth bed furnace of the present invention is not critical and can be cylindrical, rectangular, quadrilateral or any other shape. Additionally, the horizontal cross-sectional shape of the inlet 1 can be of any hollow shape which allows incinerating materials to fall therein by gravity, such as a circle, an oval, a rectangle, etc.

The hopper 3 is fixed to the inlet 1 of the furnace by angle joints 6, 6 so that it does not come into direct contact with sidewall members 4. As discussed previously, the diameter of the central aperture of the hopper 3 preferably decreases as the hopper extends into the furnace but the diameter should be large enough not to obstruct the entry of incinerating materials into the furnace. The angle of entry into the hopper 3 may be so large that incinerating materials can slide down therein smoothly and yet prevent the waste gas from flowing upstream through cooperation with the baffle 5. That is, the angle of the hopper 3 may be preferably from 10° to 80°, more preferably from 20° to 70°, with respect to the sidewall of the inlet.

The baffles 5 are located near the upper part of the inlet 1 into which the incinerated materials are introduced, as shown in FIG. 1, and is preferably a cylindrical member which increases in diameter as it extends upwardly. That is, the diameter of the baffle 5 decreases as it extends downwardly. If a plurality of baffles are used, they are preferably located a specific distance from each other. The diameter of the central aperture of the baffle 5 is preferably the same as that of the hopper 3 and the outer edge of the hopper is spaced from the sidewall a distance small enough to allow a space for the waste gas to flow upstream therein. The baffle 5 is preferably angled at an amount equivalent to that of the hopper 3. However, the angle of the baffle 5 may be different from that of the hopper 3. Additionally, if possible, the baffles 5 may be fixed to the wall of the incineration furnace by angle joints strong enough to bear the physical shock caused by contact with falling incinerating materials.

There is no particular limitation to the materials that can be incinerated in the present invention and specific examples thereof are plastics having high calorific values, materials which emit bad-smelling or corrosive gases, such as HCl, $SO_x$ or $NO_x$, or anything that can be incinerated such as waste generated during the normal course of living.

The operation of the particle incinerating furnace of the present invention is as follows. Hearth particles B are continuously or intermittently introduced into the furnace through inlet 8 and fall by gravity in the space formed by sidewall 9 and sidewall 4 until they contact with the upper surface of channel member 12 where they form a hearth particle bed layer 15 which flows along the upper surface of the channel member 12. Incinerating materials A are fed into the furnace through inlet 1 where they fall through a hopper 3 and are directed toward the center of the hopper by baffles 5 contained therein. The incinerating material A falls through the hopper 3 and into the combustion chamber 7 into contact with the hearth particle bed layer 15 flowing down the channel member 12. The baffles 5 aid in the prevention of waste gas flowing upstream.

The air used in incinerating the materials A is generally supplied from the inlet 1 to the furnace. However, supplemental air for incineration is provided by mixing the high temperature waste gas from the incineration and fresh air and is introduced into the combustion chamber through air inlets 11 provided in a plate member 10. The supplemental air flows through the air inlets 11 and into contact with the channel members 12 where the air flow is redistributed by flowing through apertures 13, 14 provided in legs of the channel 12. The air finally flows through the spaces provided between the particles forming the hearth particle bed layer 15 and into the combustion chamber 7 to promote the burning of the materials A therein. The combustion residues C mix with the hearth particles B and exit from the furnace via outlet 16 and are deposited on a removal means such as the conveyor belt 17 illustrated in FIG. 1. The outlet 16 is shaped so that the mixture of combustion residue C and hearth particles B are deposited on the conveyor belt 17 at an angle equal to the angle of repose of the hearth particles B. As such, if the movement of the conveyor belt 17 stops, the discharge of the material out of the outlet 16 also stops. The conveyor belt carries the mixture of hearth particles B and combustion residue C to a container 18 where the hearth particles can be separated from the combustion residue and reused in the furnace.

The waste gas of combustion travels up along wall 19, through a heat exchanger member 20, an exhaust pipe 21 and into a cooling and washing tower 22. The gas is then sent through an exhaust pipe 23, a ventilating fan 24 and out of chimney 25. A portion of the high temperature waste gas from the combustion chamber is sent through a duct 26, circulation fan 27 and a duct 28 where it is mixed with fresh air from the air inlet 29 and blown through air inlets 11 to promote burning of the materials A.

EXAMPLE

A hearth particle bed furnace according to the present invention was used to incinerate waste plastics used in the medical field. The hearth particles B were crushed stones of serpentinite, produced in the Chichibu area of Saitama Prefecture, Japan, having a mean diameter of 5 cm. The waste plastics, including injectors, were crushed and incinerated. The area of the furnace bed was 0.1 square meters (0.2 m×0.5 m) and a mixture of combustion gas and fresh air at approximately 300° C. was supplied during the incineration. The air inlets 13 provided in the channel members 12 were 78 in total and the shape of the apertures was a circle with a diameter of 1 cm. The amount of air flow per aperture was 100 L/min and no change was found in the air flow after one month of continuous operation.

COMPARATIVE EXAMPLE

A comparative furnace was prepared which was identical to the furnace of the above Example having the same furnace bed area and allowing the same amount of air flow was used with the exception being that the channel members 12 were not used. At the beginning of the operation, the amount of air flow was 100 L/min per aperture. After operation for a month, the air flow decreased to 50 L/min per aperture and there was trouble in incinerating the material.

The present invention allows for the incineration of materials in a larger volume in a more compact incinerating furnace by a stable and lengthy operation as compared with conventional incinerating furnaces or particle incinerating furnaces. Additionally, even if the incinerating material emit harmful or foul-smelling gases such as HCl, $SO_x$, $NO_x$, etc., leakage of these gases from the furnace does not occur. Moreover, if the incinerating materials have a high calorific value, such as plastics, the present invention can prevent the damages by the flame at the hearth bed.

Although the present invention has been described with respect to a preferred embodiment, it would be well within the scope of the art to vary elements of the present invention and yet not depart from the spirit and scope of the present invention.

What is claimed is:

1. A hearth particle bed furnace comprising means for introducing a material to be burned; means for introducing hearth particles provided adjacent to said means for introducing a material to be burned; an inclined surface provided underneath said means for introducing hearth particles; means for introducing hearth particles onto said inclined surface; a layer of hearth particles flowing down said inclined surface and forming a sloped hearth particle bed having a slope angle equal to the angle of repose of the hearth particles; means for introducing the material to be burned onto the sloped hearth particle bed; means for combusting the material to be burned and form a combustion mixture comprising the hearth particles and a combustion residue from the material to be burned; at least one channel member provided above said inclined surface; air inlet means provided in said inclined surface for promoting combustion of the material to be burned; and a plurality of air flow redistribution apertures provided in sides of said at least one channel member for redistributing air flow through said sloped hearth particle bed.

2. The hearth particle bed furnace of claim 1, wherein said at least one channel member has an upper surface having an angle of inclination equal to the angle of inclination of said inclined surface and said hearth particles flow along the upper surface of said channel member.

* * * * *